US007677063B2

(12) United States Patent
Jeon et al.

(10) Patent No.: US 7,677,063 B2
(45) Date of Patent: Mar. 16, 2010

(54) WASHING MACHINE

(75) Inventors: Si Moon Jeon, Seoul (KR); Dong Won Kim, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 1149 days.

(21) Appl. No.: 11/260,381

(22) Filed: Oct. 28, 2005

(65) Prior Publication Data

US 2006/0101865 A1 May 18, 2006

(30) Foreign Application Priority Data

Nov. 4, 2004 (KR) ..... 10-2004-0089390

(51) Int. Cl.
*D06F 37/30* (2006.01)

(52) U.S. Cl. ..... 68/58; 68/140

(58) Field of Classification Search ..... 68/133, 68/140

See application file for complete search history.

(56) References Cited

U.S. PATENT DOCUMENTS 2,975,528 A * 3/1961 Shewmon ..... 34/601
3,576,378 A * 4/1971 Hilmanowski ..... 137/565.31
3,604,222 A * 9/1971 Wutherich et al. ..... 68/24
5,526,657 A * 6/1996 Johnson ..... 68/3 R
6,612,138 B2 * 9/2003 Ryu et al. ..... 68/58
2002/0000108 A1 1/2002 Heyder et al.
2003/0006665 A1 1/2003 Kim et al.

FOREIGN PATENT DOCUMENTS

DE 2 343 070 * 3/1975
JP 05-253390 A 10/1993
KR 10-2001-0037517 A 5/2001

OTHER PUBLICATIONS

European Patent Office 1 275 765 Jan. 2003.*

* cited by examiner

*Primary Examiner*—Frankie L Stinson
(74) *Attorney, Agent, or Firm*—Birch, Stewart, Kolasch & Birch, LLP

(57) ABSTRACT

Disclosed herein is a washing machine. A stator is mounted at the inside surface of a tub, a spider is mounted at a drum, a rotor is mounted at the spider such that the rotor is rotated by the stator, and a support shaft is mounted at the spider for supporting the drum, the rotor, and the spider. Consequently, the capacities of the drum and the tub are increased as compared with the case that the stator and the rotor are mounted at the rear of the tub, and therefore, washing capacity of the washing machine is greatly increased.

20 Claims, 4 Drawing Sheets

WASHING MACHINE

BACKGROUND OF THE INVENTION

1. Field of the Invention

The present invention relates to a washing machine, and, more particularly, to a washing machine having a motor disposed inside a tub, whereby washing capacity of the washing machine is greatly increased.

2. Description of the Related Art

FIG. 1 is a side view, in section, showing a conventional washing machine.

As shown in FIG. 1, the conventional washing machine comprises: a cabinet 2 forming the external appearance of the washing machine, the cabinet 2 having a laundry inlet/outlet hole formed at the front surface thereof for allowing laundry m to be put into or removed from the cabinet 2; a door 4 hingedly mounted at the front surface of the cabinet 2 for opening and closing the laundry inlet/outlet hole; a tub 6 mounted in the cabinet 2 in a shock absorbing fashion; a water supply unit 10 for supplying detergent or wash water w into the tub 6; a water draining unit 12 for draining the wash water w in the tub 6 out of the cabinet 2; a drum 20 rotatably disposed in the tub 6 for receiving the laundry m; and a motor 30 for rotating the drum 20.

The tub 6 has an opening hole 7, which is disposed at the rear of the laundry inlet/outlet hole of the cabinet 2 such that the laundry m can be put into or removed from the drum 20. Through the center of the rear surface of the tub 6 is inserted a drive shaft 32 of the motor 30.

The drum 20 has an opening hole 7, which is also disposed at the rear of the laundry inlet/outlet hole of the cabinet 2 such that the laundry m can be put into or removed from the drum 20. The drum 20 is disposed such that the lower part of the drum 20 is submerged in the wash water received in the tub 6. The drum 20 is provided at the circumferential surface and the rear surface thereof with a plurality of through-holes 22.

At the inner circumferential surface of the drum 20 are mounted lifters 26 for lifting the laundry m received in the drum 20 to the inner upper part of the drum 20 such that the lifted laundry m falls due to gravity.

At the rear surface of the drum 20 is mounted a spider 28, to which the drive shaft 32 of the motor 30 is securely connected.

The motor 30 is mounted at the rear of the tub 6. The motor 30 is horizontally or nearly horizontally disposed such that the drive shaft 32 is connected to the center of the rear surface of the drum 20 through the center of the rear surface of the tub 6.

The motor 30 comprises: the above-described drive shaft 32; a motor frame 36 fixed to the rear surface of the tub 6, the motor frame 36 having a through-hole, through which the drive shaft 32 is inserted; a stator 40 fixed to the motor frame 36; and a rotor 44 fixed to the drive shaft 32 for performing rotation by an electromagnetic force generated between the stator 40 and the rotor 44.

The drive shaft 32 has one end fixed to the spider 28 of the drum 20 and the other end protruding toward the rear of the tub 6 such that the drive shaft 32 is inserted through the tub 6 and the motor frame 36.

The motor frame 36 is bent such that the edge of the motor frame 36 protrudes in the circumferential direction, and the motor frame 36 is fixed to the rear surface of the tub by means of fixing bolts 37.

The stator 40 is formed in the shape of a hollow cylinder. The stator 40 is fixed to the rear surface of the motor frame 36 by means of fixing bolts 41*b*.

The rotor 44 comprises: a cup-shaped rotor frame 45; and a magnet 46 fixed to the inner circumferential surface of the rotor frame 45 while being spaced apart from the stator 36.

Unexamined reference numeral 49 indicates a gasket disposed between the laundry inlet/outlet hole of the cabinet 2 and the opening hole 7 of the tub 6.

Now, the operation of the conventional washing machine with the above-stated construction will be described.

When a user puts laundry m into the drum 20, closes the door 4, and operates the washing machine, wash water w containing detergent dissolved therein, which is supplied from the water supply unit 10, is gathered in the inner lower part of the tub 6, the lower part of the drum 20 is submerged in the wash water w containing detergent dissolved therein, and the laundry m received in the drum 20 is wetted by the wash water w containing detergent dissolved therein, which is introduced into the drum 20 through the through-holes 22 of the drum 20.

When electric voltage is applied to a coil 43 of the motor 30, an electromagnetic force is generated between the coil 43 and the magnet 46, and therefore, the magnet 46 is rotated. The rotating force of the magnet 46 is transmitted to the drive shaft 32 through the rotor frame 45, and the drum 20 is rotated by the drive shaft 32.

While the drum 20 is rotated, the laundry m is lifted by the lifters 26, and then falls from the lifters 26. At this time, contaminants are separated from the laundry m by the actions of the detergent and the wash water w. After the above-described washing operation is completed, the contaminated wash water in the tub 6 is drained out of the washing machine through the water draining unit 12.

Subsequently, clean water w containing no detergent is supplied to the tub 6 through the water supply unit 10. When electric voltage is applied to the coil 43 of the motor 30 as in the washing operation, the drum 20 is rotated by the drive shaft 32. As a result, the laundry m is lifted by the lifters 26, and then falls from the lifters 26. At this time, bubbles are removed from the laundry m, and the contaminated water is drained out of the washing machine through the water draining unit 12.

Thereafter, electric voltage, which is higher than that used in the washing operation or the rinsing operation, is applied to the coil 43 of the motor 30, and therefore, the drum 20 is rotated at high speed by the drive shaft 32. As a result, moisture is centrifugally separated from the laundry m. The separated moisture is collected in the tub 6 through the through-holes 22 of the drum 20, and is then drained out of the washing machine through the water draining unit 12.

In the conventional washing machine with the above-stated construction and operation, however, the motor 30 is mounted outside the tub 20 at the rear of the tub 20. As a result, washing capacity of the washing machine is decreased, and vibration and noise generated from the motor are increased. Furthermore, the rotor 44 may collide with the cabinet 2, and therefore, noise due to the collision may be generated. In addition, safety of the washing machine is lowered.

SUMMARY OF THE INVENTION

Therefore, the present invention has been made in view of the above problems, and it is an object of the present invention to provide a washing machine having a motor disposed inside a tub, whereby washing capacity is greatly increased, and noise and vibration is minimized.

It is another object of the present invention to provide a washing machine having a rotor, material costs of which are reduced.

It is yet another object of the present invention to provide a washing machine that is capable of heating wash water with heat generated from the motor, thereby improving washing efficiency and saving energy.

In accordance with one aspect of the present invention, the above and other objects can be accomplished by the provision of a washing machine comprising: a tub mounted in a cabinet; a drum rotatably disposed in the tub; a spider mounted at the drum; a stator mounted at the inside surface of the tub; a rotor mounted at the spider; and a support shaft mounted at the spider.

Preferably, the stator is integrally attached to the tub by insert molding.

Preferably, the rotor is integrally attached to the spider by insert die casting.

Preferably, the rotor is securely fixed to the spider by means of fixing members.

Preferably, the washing machine further comprises: a slip ring mounted at the tub for maintaining the seal between the rotor and the tub.

Preferably, the washing machine further comprises: bearings for rotatably supporting the support shaft.

Preferably, the washing machine further comprises: a bearing housing disposed at the tub for accommodating the bearings.

In accordance with another aspect of the present invention, there is provided a washing machine comprising: a tub mounted in a cabinet; a drum rotatably disposed in the tub; a stator mounted at the inside surface of the tub; a rotor mounted at the drum; and a support shaft mounted at the drum.

Preferably, the washing machine further comprises: a slip ring mounted at the tub for maintaining the seal between the rotor and the tub.

Preferably, the washing machine further comprises: a bearing housing having bearings for rotatably supporting the support shaft.

According to the present invention, the stator is mounted at the inside surface of the tub, the spider is mounted at the drum, the rotor is connected to the spider, and the support shaft is mounted at the spider. Consequently, the capacities of the drum and the tub are increased as compared with the case that the stator and the rotor are mounted at the rear of the tub, and therefore, washing capacity of the washing machine is greatly increased.

According to the present invention, the stator and the rotor are disposed inside the tub, and therefore, noise generated when the rotor is rotated is minimized. Furthermore, the collision of the rotor and the cabinet, which may occur when the stator and the rotor are disposed outside the tub, is prevented. Consequently, noise due to collision is reduced, and safety of the washing machine is improved.

According to the present invention, the rotor is not connected to the support shaft but to the spider. Consequently, the structure of the rotor is simplified, and the material costs of the rotor are reduced.

According to the present invention, heat generated from the stator is transmitted to the wash water. Consequently, washing performance of the washing machine is improved, and power consumption due to the use of the heater is greatly reduced.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
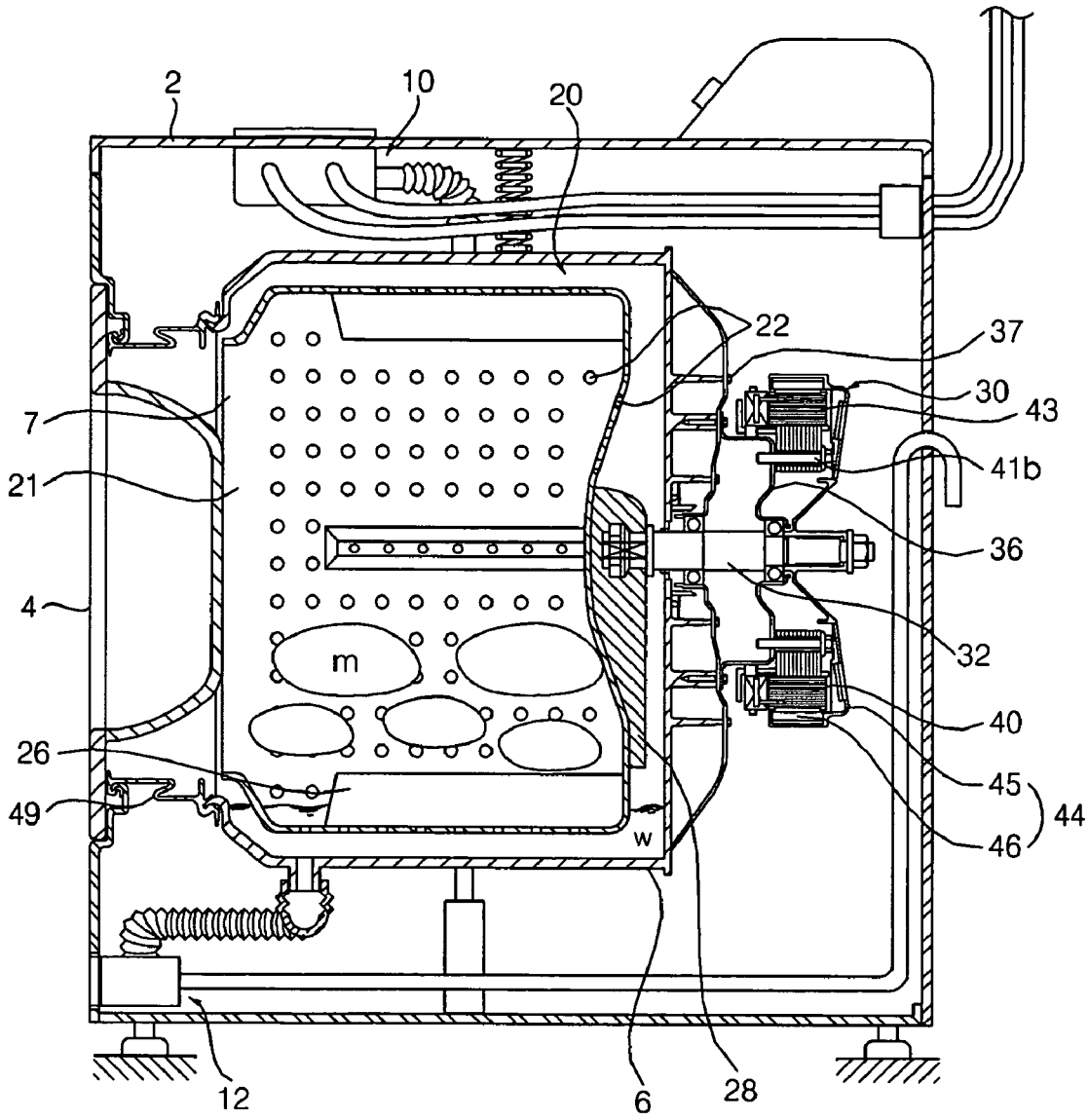
FIG. 1 (Prior Art)
FIG. 1 is a side view, in section, showing a conventional washing machine.

Now, preferred embodiments of the present invention will be described in detail with reference to the accompanying drawings. The same or similar elements are denoted by the same reference numerals even though they are depicted in different drawings, and a detailed description thereof will be omitted.

Figure 2:
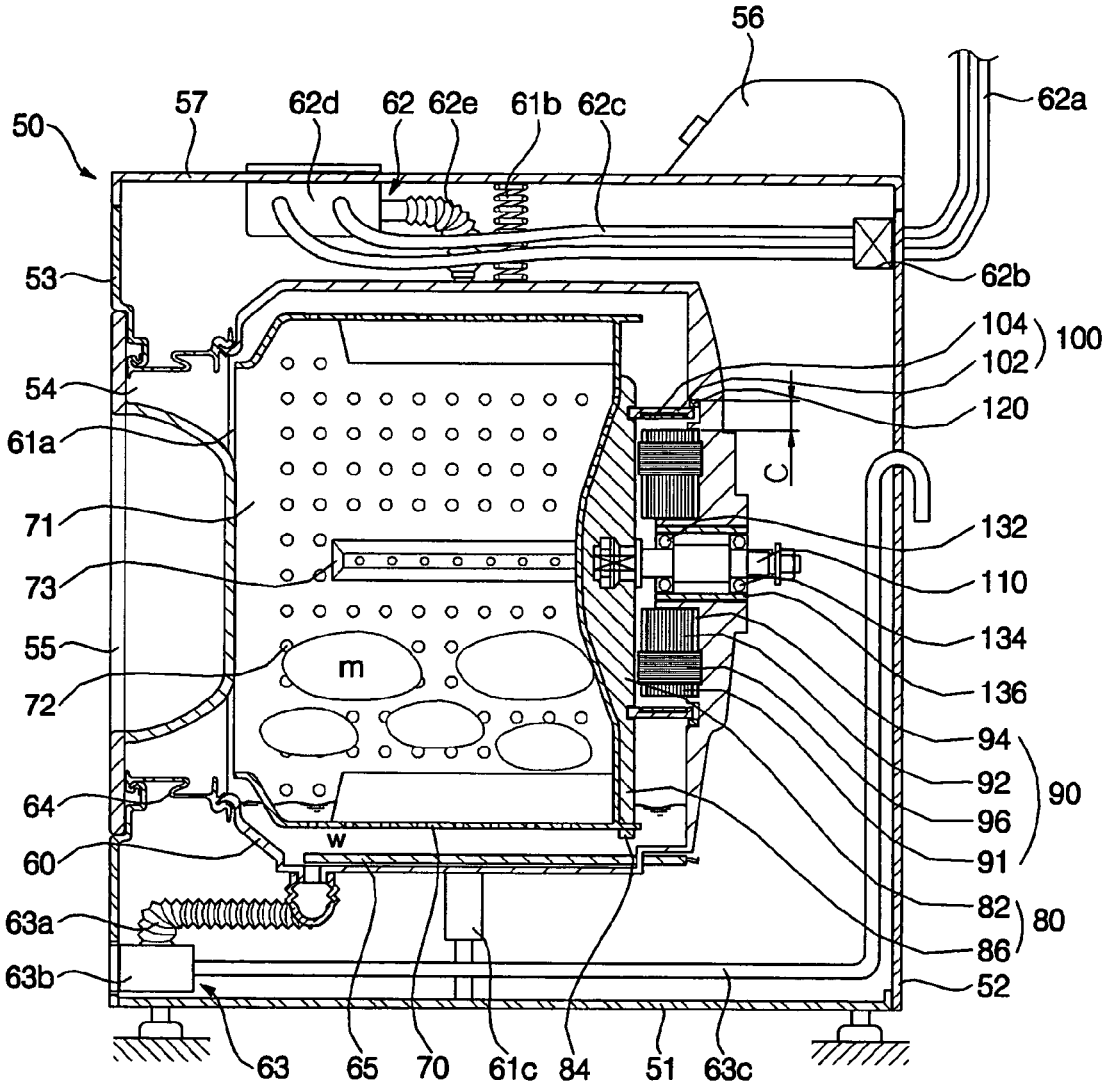
FIG. 2 is a side view, in section, showing a washing machine according to a first preferred embodiment of the present invention.

FIG. 2 is a side view, in section, showing a washing machine according to a first preferred embodiment of the present invention.

As shown in FIG. 2, the washing machine according to the first preferred embodiment of the present invention comprises: a cabinet 50 forming the external appearance of the washing machine; a tub 60 mounted in the cabinet 50; a drum 70 rotatably disposed in the tub 60; a spider 80 mounted at the drum 70; a stator 90 mounted at the inside surface of the tub 60; a rotor 100 mounted at the spider 80; and a support shaft 110 mounted at the spider 80 for supporting the drum 70, the spider 80, and the rotor 100.

The cabinet 50 comprises: a base pan 51; a cabinet body 52 disposed on the base pan 51; a cabinet cover 53 disposed at the front part of the cabinet body 52; and a top plate 57 disposed at the top part of the cabinet body 52.

At the cabinet cover 53 is formed a laundry inlet/outlet hole 54 for allowing laundry m to be put into or removed from the drum 70. To the cabinet cover 53 is hingedly connected a door 55 for opening and closing the laundry inlet/outlet hole 54.

At the upper part of the cabinet cover 53 or on the top surface of the top plate 57 is mounted a control panel 56 for allowing a user to input operation mode or operation time of the washing machine.

The tub 60 is a cylindrical member, which is disposed horizontally or inclined by predetermined degrees. The tub 60 has an opening hole 61*a* formed at the center of the front surface thereof. The stator 90 is integrally attached to the inside part of the rear surface of the tub 60 by insert molding such that some of the stator 90 is inserted in the tub 60.

The tub 60 is connected to the cabinet body 54 via a spring 61*b*, and is connected to the base pan 52 via a damper 61*c*.

To the tub 60 is connected a water supply unit 62 for supplying wash water into the tub 60.

The water supply unit 62 comprises: a water supplying valve 62*b* connected to an external hose 62*a* for allowing or interrupting introduction of wash water w from the external hose 62*a* therethrough; a water supplying hose 62*c* for guiding the wash water w passing through the water supplying valve 62*b*; a detergent box 62*d*, through which the wash water w guided through the water supplying hose 62*c* passes; and a water supplying bellows 62*e* for guiding the wash water w passing through the detergent box 62*d* to the tub 60.

To the tub 60 is connected a water draining unit 63 for draining the contaminated wash water w or moisture centrifugally separated from the laundry m out of the washing machine.

The water draining unit 63 comprises: a water draining bellows 63*a* connected to the tub 60 for guiding the wash water w or the moisture out of the tub 60; a water draining pump 63*b* for pumping out the wash water w or the moisture guided through the water draining bellows 63*a*; and a draining hose 63*c* for guiding the wash water w or the moisture pumped out by the water draining pump 63*b* out of the washing machine.

To the tub 60 is connected a gasket 64 for preventing the laundry, the wash water w, or air A from being discharged from a gap between the tub 60 and the cabinet cover 53 and another gap between the cabinet cover 53 and the door 55.

At the inside lower part of the tub 60 is mounted a heater 65 for heating the washing water w.

The drum 70 is a cylindrical member, which is disposed horizontally or inclined by predetermined degrees in the tub 60. At the center of the front surface of the drum 70 is formed an opening hole 71, through which the laundry m or the wash water w is introduced into or removed from the drum 70. At the circumferential surface of the rear surface of the drum 70 are formed through-holes 72, through which the wash water w or the air A is introduced into or discharged from the drum 70. To the inner circumferential surface of the drum 70 are attached lifters 73 for lifting the laundry m such that the lifted laundry m falls from the lifters 73.

The spider 80 comprises: a shaft connecting part 82, to which the support shaft 110 is connected; and a drum fixing part 86 protruding from the shaft connecting part 82 and fixed to the drum 70 by means of fixing members 84, such as bolts.

The stator 90 is inserted in the tub 60 such that the stator 90 is located in the inside part of the rear surface of the tub 60 while being spaced more than a predetermined gap C from the tub 60 such that the rotor 100 is rotatably disposed between the circumferential surface of the stator 90 and the tub 60.

The stator 90 comprises: a stator core 92 having a plurality of protruding poles 91 formed at the outer circumferential surface thereof, the stator core 92 being formed in the shape of a hollow cylinder; an insulating member 94 surrounding the protruding poles 91; and a coil wound on the outside of the insulating member 94. The circumferential surface or the rear surface of the stator 90 is inserted in the tub 60.

The rotor 100 is integrally attached to the spider 80 by insert die casting.

The rotor comprises: a cylindrical rotor frame 102; and a magnet 104 disposed on the inner circumferential surface of the rotor frame 102.

The front end of the rotor frame 102 is inserted in the spider 80.

The front end of the support shaft 110 is connected to the shaft connecting part 82 of the spider 80. The support shaft 110 is inserted through the tub 60. The rear end of the support shaft 110 is disposed at the rear of the tub 60.

The washing machine according to the first preferred embodiment of the present invention further comprises: a slip ring 120 mounted at the tub 60 for maintaining the seal between the rotor 100 and the tub 60.

The slip ring 120 serves to prevent wash water or foreign matter from being introduced to the stator 90 from the tub 60 through the rotor 100 and the tub 60. The slip ring 120 is formed in the shape of a cylinder. The slip ring 120 is fixed to one of the tub 60 and the rotor 100, and is disposed in sliding contact with the other.

The washing machine further comprises: bearings 132 and 134 for rotatably supporting the support shaft 110; and a bearing housing 136 disposed at the tub 60 for accommodating the bearings 132 and 134.

The bearing housing 136 is integrally attached to the tub 60 by insert molding or is securely fixed to the tub 60 by means of fixing bolts.

Now, the operation of the washing machine with the above-stated construction according to the first preferred embodiment of the present invention will be described in detail.

When a user puts laundry m into the drum 70, closes the door 55, and operates the washing machine through the control panel 56, wash water w containing detergent dissolved therein, which is supplied from the water supply unit 62, is gathered in the inner lower part of the tub 60, the lower part of the drum 70 is submerged in the wash water w containing detergent dissolved therein, and the laundry m received in the drum 70 is wetted by the wash water w containing detergent dissolved therein, which is introduced into the drum 70 through the through-holes 72 of the drum 70.

When electric voltage is applied to the coil 96 of the stator 90, an electromagnetic force is generated between the coil 96 and the magnet 104, and therefore, the magnet 104 is rotated along with the rotor frame 102, and the rotor 100 is rotated inside the tub 60.

The rotating force of the rotor frame 102 is transmitted to the spider 80, and the drum 60 is rotated along with the spider 80. While the drum 60 is rotated, the laundry m is lifted by the lifters 62, and then falls from the lifters 62. At this time, contaminants are separated from the laundry m by the actions of the detergent and the wash water w.

While the spider 80 is rotated, the support shaft 110 is supported by the bearings 132 and 134 such that the rotor 100, the spider 80, and the drum can be smoothly rotated. The slip ring 120 is in contact with the rotor 110 for preventing the wash water or foreign matter from being introduced into the stator 90.

In the case that the user selects a boil washing operation through the control panel 56, the heater 65 is turned on.

When the heater 65 is turned on, the wash water w in the tub 60 is heated by the heater 65, and therefore, the laundry is washed while being sterilized at high temperature. Heat generated from the stator 90 is transmitted to the air inside the tub 60 or the wash water w through the tub 60. Consequently, the boil washing operation of the laundry is facilitated.

After the above-described washing operation is completed, the contaminated wash water w in the tub 60 is drained out of the washing machine through the water draining unit 63.

Subsequently, a rising operation for rinsing bubbles out of the laundry m is performed several times. Specifically, clean water containing no detergent is supplied to the tub 6*o* through the water supply unit 62. When electric voltage is applied to the coil 96 of the stator 90, the rotor 100, the spider 80, the drum, and the support shaft 110 are rotated as in the washing operation. As a result, the laundry m in the drum 70 is lifted by the lifters 73, and then falls from the lifters 73. At this time, bubbles are removed from the laundry m.

Thereafter, the contaminated water containing the bubbles is drained out of the washing machine through the water draining unit 63.

After the above-described rinsing operation is performed several times, a spin-drying operation is performed for separating moisture from the laundry.

When the spin-drying operation is performed, electric voltage, which is higher than that used in the washing operation or the rinsing operation, is applied to the coil 96 of the stator 90, and therefore, the rotor 100, the spider 80, the drum 70, and the support shaft 110 are rotated at higher speed than when the washing operation or the rinsing operation is performed. As a result, laundry m in the drum 70 is pushed against the inner wall of the drum 70, and therefore, moisture is centrifugally separated from the laundry m.

The moisture, which is centrifugally separated from the laundry m as the drum 70 is rotated at high speed, is collected in the tub 60 through the through-holes 72 of the drum 70, and is then drained out of the washing machine through the water draining unit 63.

Figure 3:
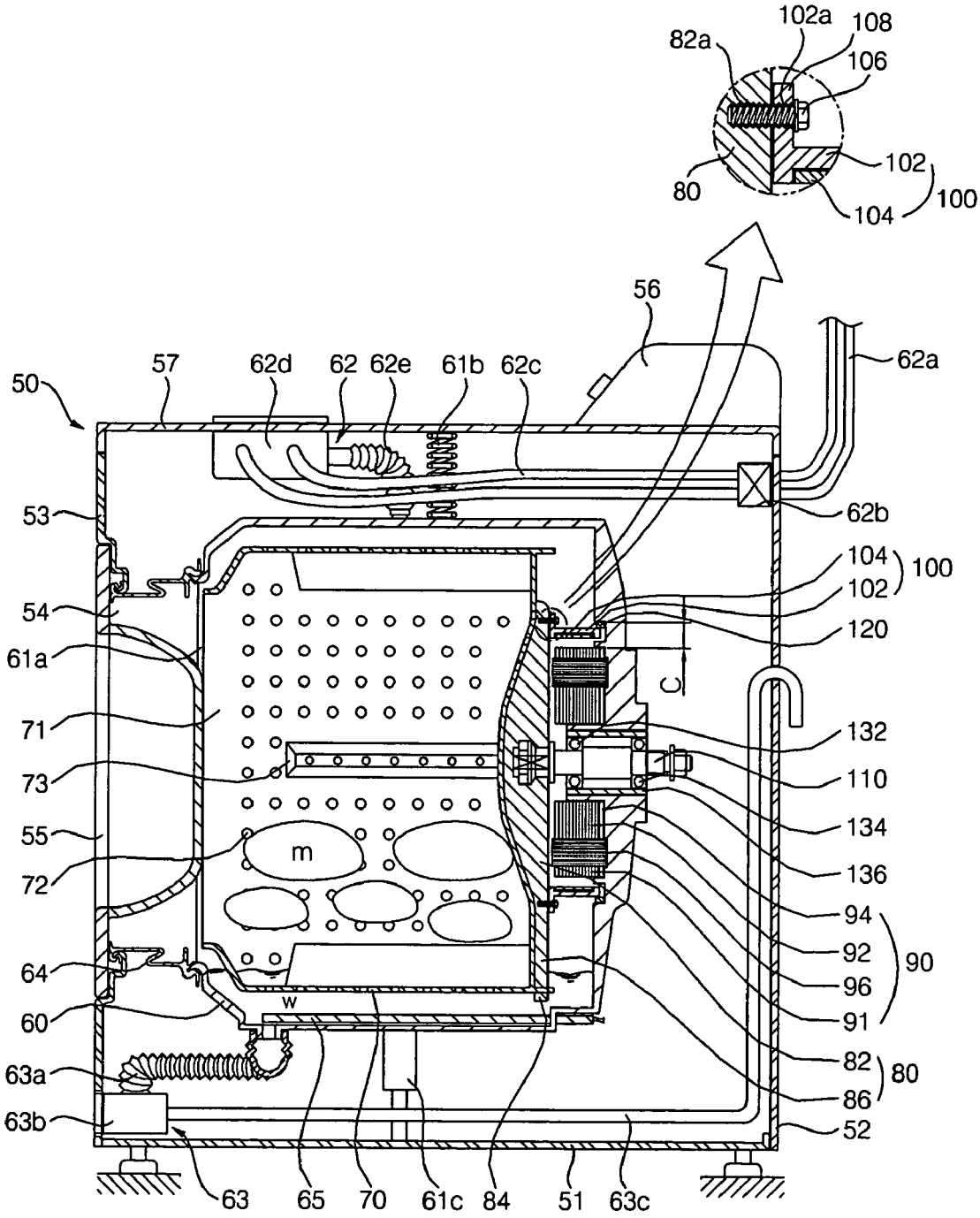
FIG. 3 is a side view, in section, showing a washing machine according to a second preferred embodiment of the present invention.

FIG. 3 is a side view, in section, showing a washing machine according to a second preferred embodiment of the present invention.

The washing machine according to the second preferred embodiment of the present invention is identical in construction and operation to the washing machine according to the first preferred embodiment of the present invention except that the rotor 100 is fixed to the spider 80 by means of fixing members 106, such as screws. Therefore, other components of the washing machine according to the second preferred embodiment of the present invention, which are identical to those of the washing machine according to the first preferred embodiment of the present invention, are indicated by the same reference numerals as those of the washing machine according to the first preferred embodiment of the present invention, and a detailed description thereof will not be given.

At the spider 80 are formed fixing holes 82*a*, into which the fixing members 106 are threadedly inserted, respectively. The rotor 100 has a fixing piece 108 protruded therefrom. At the fixing piece 108 are formed fixing holes 102*a*, through which the fixing members 106 are threadedly inserted, respectively. While the fixing holes 82*a* of the spider 80 are aligned with the corresponding fixing holes 102*a* of the rotor 100, the fixing members 106 are threadedly inserted into the fixing holes 82*a* through the fixing holes 102*a*, respectively. As a result, the rotor 100 is securely fixed to the spider 80.

Figure 4:
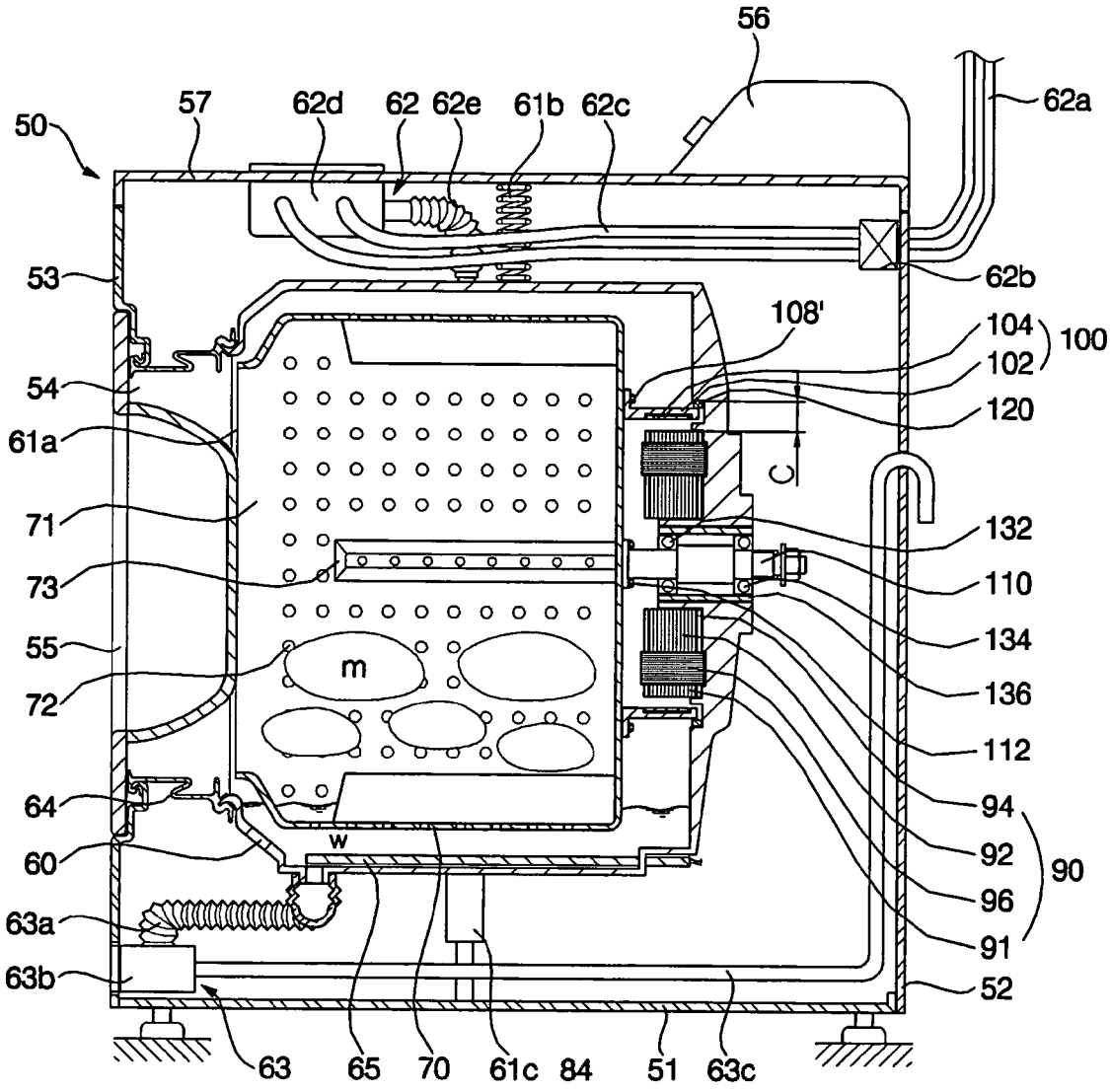
FIG. 4 is a side view, in section, showing a washing machine according to a third preferred embodiment of the present invention.

FIG. 4 is a side view, in section, showing a washing machine according to a third preferred embodiment of the present invention.

The washing machine according to a third preferred embodiment of the present invention is characterized in that the spider 80 used in the first preferred embodiment of the present invention is not mounted, the rotor 100 is directly connected to the drum 70, and the support shaft 110 is directly mounted at the drum 70, as shown in FIG. 4.

The rotor 100 and the support shaft 110 may be attached to the drum 70 by bonding. Alternatively, the rotor 100 and the support shaft 110 may be attached to the drum 70 by means of fixing members 108' and 112, respectively.

Other components of the washing machine according to the third preferred embodiment of the present invention are identical in construction and operation to those of the washing machine according to the first preferred embodiment of the present invention. Therefore, the components of the washing machine according to the third preferred embodiment of the present invention, which are identical to those of the washing machine according to the first preferred embodiment of the present invention, are indicated by the same reference numerals as those of the washing machine according to the first preferred embodiment of the present invention, and a detailed description thereof will not be given.

As apparent from the above description, the washing machine according to the present invention has the following effects.

First, the stator is mounted at the inside surface of the tub, the spider is mounted at the drum, the rotor is connected to the spider, and the support shaft is mounted at the spider. Consequently, the capacities of the drum and the tub are increased as compared with the case that the stator and the rotor are mounted at the rear of the tub, and therefore, washing capacity of the washing machine is greatly increased.

Secondly, the stator and the rotor are disposed inside the tub, and therefore, noise generated when the rotor is rotated is minimized. Furthermore, the collision of the rotor and the cabinet, which may occur when the stator and the rotor are disposed outside the tub, is prevented. Consequently, noise due to collision is reduced, and safety of the washing machine is improved.

Thirdly, the rotor is not connected to the support shaft but to the spider. Consequently, the structure of the rotor is simplified, and the material costs of the rotor are reduced.

Fourthly, heat generated from the stator is transmitted to the wash water. Consequently, washing performance of the washing machine is improved, and power consumption due to the use of the heater is greatly reduced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine comprising:

a tub mounted in a cabinet;

a drum rotatably disposed in the tub for receiving laundry;

a spider mounted at the drum to be rotated with the drum;

a stator mounted at the inside surface of the tub;

a rotor mounted at the spider, the rotor being rotated by the stator; and a support shaft fixedly mounted at the spider.

2. The washing machine as set forth in claim 1, wherein the stator is integrally attached to the tub by insert molding.

3. The washing machine as set forth in claim 1, wherein the stator is spaced more than a predetermined gap from the tub such that the rotor is rotatably disposed between the circumferential surface of the stator and the tub.

4. The washing machine as set forth in claim 1, wherein the stator comprises:

a stator core having a plurality of protruding poles formed at the outer circumferential surface thereof, the stator core being formed in the shape of a hollow cylinder;

an insulating member surrounding the protruding poles; and a coil wound on the outside of the insulating member.

5. The washing machine as set forth in claim 1, wherein a rear surface of the stator is inserted in the tub.

6. The washing machine as set forth in claim 1, wherein the rotor is integrally attached to the spider by insert die casting.

7. The washing machine as set forth in claim 1, wherein the rotor is securely fixed to the spider by means of fixing members.

8. The washing machine as set forth in claim 1, wherein the rotor comprises:

a cylindrical rotor frame; and a magnet disposed on the inner circumferential surface of the rotor frame.

9. The washing machine as set forth in claim 1, wherein the spider comprises:

a shaft connecting part, to which the support shaft is connected; and a drum fixing part protruding from the shaft connecting part and fixed to the drum.

10. The washing machine as set forth in claim 9, wherein the spider has fixing holes, into which the fixing members are threadedly inserted, respectively, and the rotor has a fixing piece protruded therefrom, the fixing piece being provided with fixing holes, through which the fixing members are threadedly inserted, respectively.

11. The washing machine as set forth in claim 1, further comprising:

a slip ring mounted at the tub for maintaining the seal between the rotor and the tub.

12. The washing machine as set forth in claim 11, wherein the slip ring is fixed to one of the tub and the rotor, and is disposed in sliding contact with the other.

13. The washing machine as set forth in claim 1, further comprising:

bearings for rotatably supporting the support shaft.

14. The washing machine as set forth in claim 13, further comprising:

a bearing housing disposed at the tub for accommodating the bearings.

15. The washing machine as set forth in claim 14, wherein the bearing housing is integrally attached to the tub by insert molding.

16. A washing machine comprising:

a tub mounted in a cabinet;

a drum rotatably disposed in the tub;

a spider mounted at the drum;

a stator integrally attached to the inside part of the rear surface of the tub by insert molding such that some of the stator is inserted in the tub;

a rotor integrally attached to the spider by insert die casting such that some of the rotor is inserted in the spider, the rotor being rotated by the stator;

a support shaft mounted at the spider for supporting the spider; and a bearing housing having bearings for rotatably supporting the support shaft.

17. The washing machine as set forth in claim 16, further comprising:

a slip ring mounted at the tub for maintaining the seal between the rotor and the tub.

18. A washing machine comprising:

a tub mounted in a cabinet;

a drum rotatably disposed in the tub for receiving laundry;

a stator mounted at an inside surface of a rear side of the tub to be protruded toward the drum;

a rotor mounted at an outside surface of a rear side of the drum to be protruded toward the rear side of the tub such that the rotor is disposed around the stator; and a support shaft mounted at the drum for supporting the drum.

19. The washing machine as set forth in claim 18, further comprising:

a slip ring mounted at the tub for maintaining the seal between the rotor and the tub.

20. The washing machine as set forth in claim 18, further comprising:

a bearing housing having bearings for rotatably supporting the support shaft.

* * * * *